US007953337B2

(12) United States Patent
Kotani

(10) Patent No.: US 7,953,337 B2
(45) Date of Patent: May 31, 2011

(54) IMAGE FORMING DEVICE AND METHOD OF INITIALIZING THE SAME

(75) Inventor: Masaki Kotani, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 669 days.

(21) Appl. No.: 11/935,158

(22) Filed: Nov. 5, 2007

(65) Prior Publication Data

US 2008/0107460 A1 May 8, 2008

(30) Foreign Application Priority Data

Nov. 8, 2006 (JP) ..... 2006-303087

(51) Int. Cl.
*G03G 15/20* (2006.01)

(52) U.S. Cl. ..... 399/70; 399/330; 219/216

(58) Field of Classification Search ..... 399/67, 399/69, 70, 320, 330; 219/216
See application file for complete search history.

(56) References Cited

U.S. PATENT DOCUMENTS 5,225,871 A * 7/1993 Tanimoto ..... 399/70
5,600,406 A * 2/1997 Aikawa et al. ..... 399/70

FOREIGN PATENT DOCUMENTS

| | | | |
|---|---|---|---|
| JP | 04-295873 | | 10/1992 |
| JP | 08-292892 | | 11/1996 |
| JP | 08292892 | A | 11/1996 |
| JP | 2002278409 | A | 7/2002 |
| JP | 2003-156964 | | 5/2003 |
| JP | 2003211785 | A | 7/2003 |
| JP | 2004252432 | A | 9/2004 |
| JP | 2004265650 | A | 9/2004 |
| JP | 2004354406 | A | 12/2004 |
| JP | 2005031242 | A | 2/2005 |

OTHER PUBLICATIONS

Japanese office action and its corresponding English language office action for corresponding Japanese application 2006303087 lists the references above.
Japanese language office and its English language translation for corresponding Japanese application 2006303087 lists the reference above.

* cited by examiner

*Primary Examiner* — David P Porta
*Assistant Examiner* — Benjamin Schmitt
(74) *Attorney, Agent, or Firm* — DLA Piper LLP (US)

(57) ABSTRACT

An image forming device equipped with a heater for fusing toner on a recording medium. A first memory stores an initialization program and a control program. A second memory is provided for reading the control program. The initialization program stored in the first memory is configured to drive the heater before the control program is copied from the first memory to the second memory.

4 Claims, 3 Drawing Sheets

IMAGE FORMING DEVICE AND METHOD OF INITIALIZING THE SAME

CROSS-REFERENCE TO RELATED APPLICATIONS

This application claims priority under 35 U.S.C. 119 to Japanese Patent Application No. 2006-303087, filed on Nov. 8, 2006, which application is hereby incorporated by reference in its entirety.

BACKGROUND OF THE INVENTION

1. Field of the Invention

The present invention relates to an image forming device equipped with a heater for heat fusing the toner, and a method of initializing the same.

2. Description of the Related Art

A conventional reprographic system is equipped with a printer unit including a fuser section, and is also equipped with a Read Only Memory (ROM) and a Random Access Memory (RAM). When the power is turned ON, a load program of a control program is activated on the ROM, various control programs such as a Video Graphics Array (VGA) control program and a Light Emitting Diode (LED) display control program are loaded from the ROM to the RAM and activated, and an image formable state is ultimately achieved.

SUMMARY OF THE INVENTION

Generally, a substantial amount of time is required until a temperature of the heater rises to the temperature necessary for toner fusion from when the heater of the fuser section is driven in the image forming device. In this regard, the heater of the fuser section cannot be driven until the control program of a fuser is read from the ROM to the RAM and activated by the load program. Therefore, the time from when the power is turned ON until a printable state is achieved becomes long, and improvement can still be made in terms of convenience.

In view of the above situation, the present invention aims to reduce the time from turning ON the power until an image formable state is achieved in an image forming device equipped with a heater for toner fusion.

The problems to be solved by the present invention are described above, and now, the means for solving such problems and the effects thereof are described below.

In order to overcome the problems described above, one embodiment of the present invention relates to an image forming device equipped with a heater for fusing toner on a recording medium. The device includes a first memory for storing an initialization program and a control program; and a second memory for reading the control program. The initialization program stored in the first memory is configured to be able to drive the heater before the control program is copied from the first memory to the second memory.

According to such configuration, the temperature of the heater (and member heated by the heater) can be raised to a certain extent during a copying process of the control program from the first memory to the second memory. Therefore, the heater temperature reaches a temperature suited for toner fusion in a short period of time after a start of execution of the control program. As a result, the image formation can rapidly start after the power is turned ON, thereby enhancing the convenience of the image forming device.

The above image forming device may further include a temperature sensor for detecting the temperature of the heater or a member heated by the heater. The initialization program examines a detected value of the temperature sensor before copying the control program from the first memory to the second memory, and drives the heater only if the detected value is lower than or equal to a predetermined temperature.

According to such configuration, the heater is not driven during the copying process of the control program if the temperature of the heater (or member heated by the heater) is already sufficiently raised when the power is turned ON, and thus an excessive temperature rise of the heater can be avoided.

In the image forming device described above, the initialization program preferably stops the heater if the heater is being driven after copying the control program from the first memory to the second memory.

According to such configuration, excessive temperature rise of the heater can be reliably prevented since the heater is reliably stopped at the start of execution of the control program even in times of unexpected occurrence such as the control program going out of control during execution.

In the image forming device described above, the first memory is preferably a non-volatile memory and the second memory is a volatile memory.

According to such configuration, the initialization program and the control program are stably stored in the first memory, and an inexpensive volatile memory is used for the second memory, whereby the cost is reduced.

A second aspect of the present invention relates to a method of controlling (initialization program stored in a memory of) an image forming device equipped with a heater for fusing toner on a recording medium. The method includes a first step of driving the heater; and a second step of copying a control program stored in the memory to another memory; wherein the first step is performed before the second step.

Therefore, the temperature of the heater (and member heated by the heater) can be raised to a certain extent during the copying process of the control program from the memory to another memory. Therefore, the heater temperature reaches the temperature suited for toner fusion in a short period of time after the start of execution of the control program, and thus the image formation can rapidly start after the power is turned ON, thereby enhancing the convenience of the image forming device.

In the method of controlling the image forming device (initialization program), the temperature of the heater or a member heated by the heater is preferably detected, and the first step is executed only if the detected temperature is lower than or equal to a predetermined temperature.

Thus, the heater is not driven during the copying process of the control program if the temperature of the heater (or member heated by the member) is already sufficiently raised when the power is turned ON, and thus excessive temperature rise of the heater can be avoided.

In the method of controlling the image forming device (initialization program), the method further includes a third step of stopping the heater, the third step being preferably performed after the second step.

Accordingly, excessive temperature rise of the heater can be reliably prevented since the heater is reliably stopped at the start of execution of the control program even in times of unexpected occurrence such as the control program going out of control during execution.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
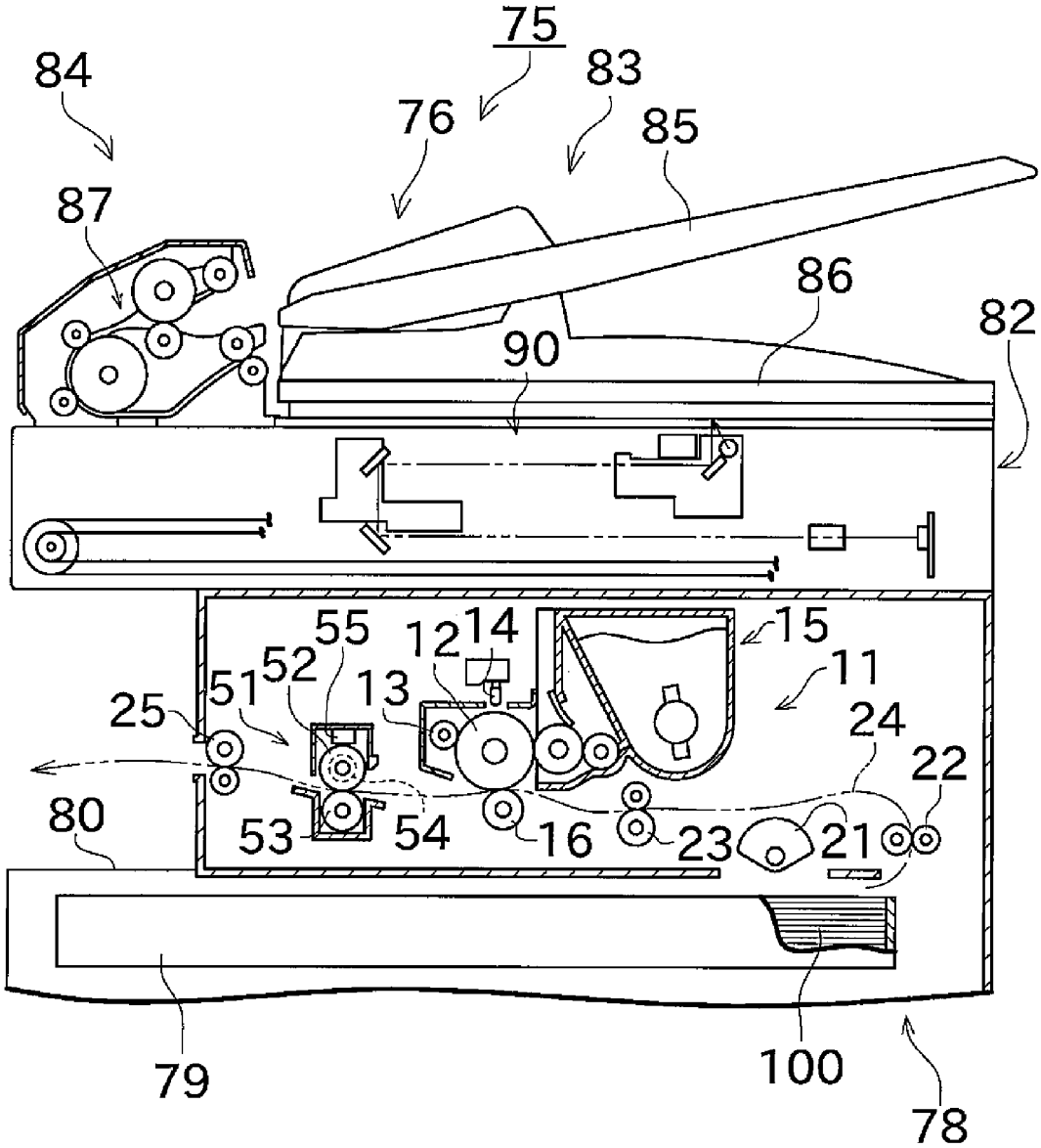
FIG. 1 is a front, partial-cross sectional view of a copy-facsimile multifunction peripheral according to one embodiment of the present invention.
Figure 2:
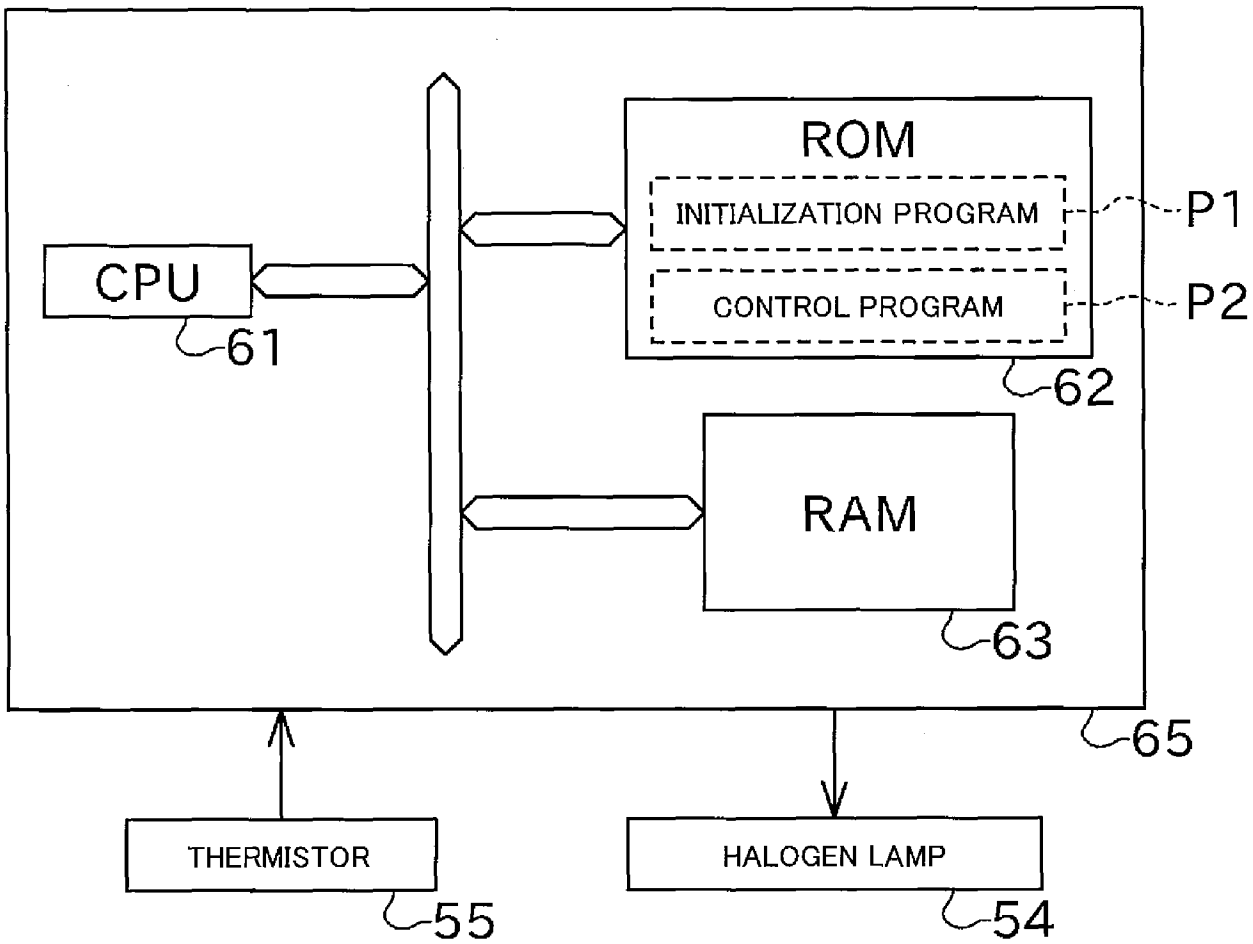
FIG. 2 is a block diagram of an electrical configuration for halogen lamp control of a fuser device according to one embodiment of the present invention.
Figure 3:
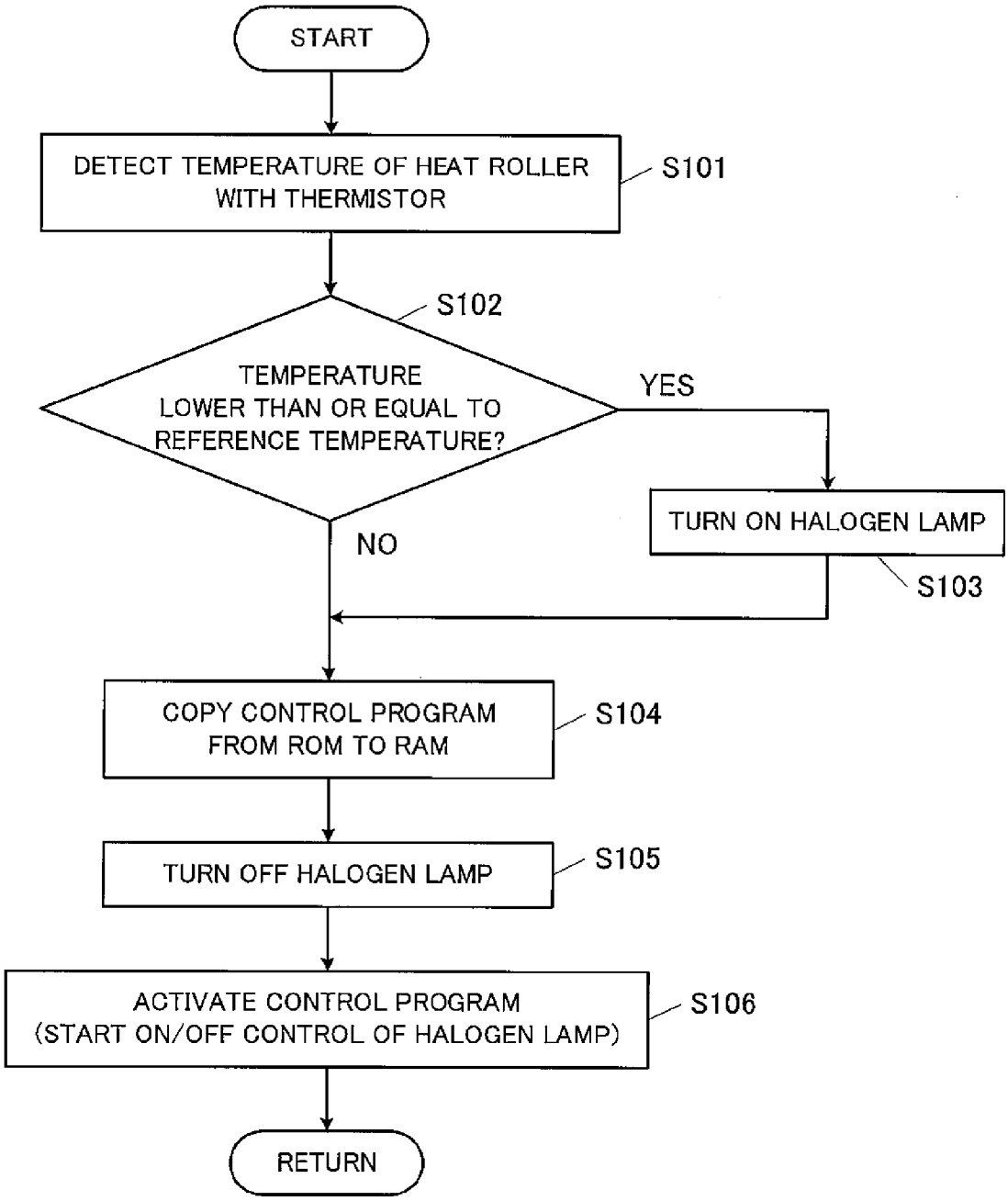
FIG. 3 is a flowchart of an initialization program stored in the ROM according to one embodiment of the present invention.

An embodiment of the invention is now described. FIG. 1 is a front, partial cross-sectional view showing an inside of a main body of a copy-facsimile multifunction peripheral according to one embodiment of the present invention. FIG. 2 is a block diagram of an electrical configuration for halogen lamp control of a fuser device, and FIG. 3 is a flowchart of an initialization program stored in the ROM.

As shown in FIG. 1, a copy-facsimile multifunction peripheral 75 serving as the image forming device includes an image reading unit 76 functioning as a flat bed scanner and an auto document feed scanner; a main body 78 incorporating an image forming section 11 and the like for forming an image on a paper serving as a recording medium; and a paper feed cassette 79 for sequentially feeding the paper. The main body 78 includes a transmission/reception section (not shown) and the like for transmitting the image via a communication line.

The image reading unit 76 includes a platen 82 with a platen glass, and a platen cover 83 for pressing the reading document to the platen glass. An auto document feeder (ADF) 84 is also arranged in the platen cover 83.

The ADF 84 includes a document tray 85 arranged on an upper part of the platen cover 83, and a discharge tray 86 arranged on a lower side of the document tray 85. A document transportation passage 87 is formed inside the platen cover 83, where the content is read by being scanned with a scanner unit 90, and the document is discharged to the discharge tray 86 while transporting the document on the document tray 85 along the document transportation passage 87. When the ADF 84 is used as a flat bed scanner, the scanner unit 90 scans the reading document placed on the platen glass while moving to read the content thereof.

The configuration for image formation is now described. As shown in FIG. 1, the paper feed cassette 79 for feeding paper 100 is arranged at a lower part of the main body 78. The image forming section 11, the fuser device 51, and the discharge tray 80 are arranged above the paper feed cassette 79.

A transportation path 24 for transporting the paper 100 from the paper feed cassette 79 to the discharge tray 80 is formed inside the main body 78. The transportation path 24 is extends to an upper side from one end side of the paper feed cassette 79, curves in a horizontal direction up to the image forming section 11, and then extends in a horizontal direction and passes through the fuser device 51 to the discharge tray 80.

A paper feed roller 21 is arranged above the paper feed cassette 79, where the paper feed roller 21 contacts the uppermost paper 100 stacked in the paper feed cassette 79. When the paper feed roller 21 is driven in such a state, the uppermost paper 100 is separated and picked up, and then fed towards the transportation path 24. Thereafter, the paper 100 is transported in the transportation path 24 towards the image forming section 11 by transportation rollers 22, 23 and the like.

As shown in FIG. 1, the image forming section 11 has a configuration in which a charger 13, an exposing part 14, a developing part 15, and a transfer roller 16 are arranged around a photoconductive drum 12.

The photoconductive drum 12 has a photoconductive film of an organic photoreceptor formed on a surface, and is configured to be rotatably driven by an electrically operated motor (not illustrated). The surface of the photoconductive drum 12 is uniformly charged by the charger 13, and an electrostatic latent image is formed thereon by the exposing part 14. The electrostatic latent image is then toner developed by the developing part 15. The toner image formed on the surface of the photoconductive drum 12 is transferred onto the paper 100 at the portion of the transfer roller 16. The paper 100 transferred with the toner image is sent to the fuser device 51 on a downstream side of the transportation path 24 through rotation of the photoconductive drum 12.

The fuser device 51 includes a heat roller 52 incorporating a halogen lamp 54, which serves as a heat source (heater), and is rotatably driven, and a press roller 53 arranged facing the heat roller 52. According to such configuration, when the paper 100 passes between the heat roller 52 and the press roller 53, the toner of the toner image is fused by the heat of the heat roller 52 of high temperature and the pressure by the press roller 53 and is fused on the paper 100. The paper 100 after fusion is discharged onto the discharge tray 80 by the discharge roller 25.

The fuser device 51 is equipped with a thermistor (temperature sensor) 55, so that a temperature of the heat roller 52 heated by the halogen lamp 54 can be detected. A control unit, to be hereinafter described, controls the halogen lamp 54 based on the detected temperature of the thermistor 55, and performs control such that the temperature of the heat roller 52 becomes a temperature suited for toner fusion.

The electrical configuration of the copy-facsimile multifunction peripheral 75 of the present embodiment will now be described. As shown in FIG. 2, the copy-facsimile multifunction peripheral 75 includes a control unit 65. The control unit 65 includes a CPU 61 serving as a computation means, a ROM (read-only memory, non-volatile memory, first memory) 62 serving as a storage means, and a RAM (read/write memory, volatile memory, second memory) 63 also serving as a storage means. An initialization program P1 executed at the beginning when the power is turned ON, and a control program P2 executed thereafter are stored in the ROM 62 in advance.

The thermistor 55 for detecting the temperature of the heat roller 52 of the fuser device 51 is connected to the control unit 65, so that the information of the detected temperature is transmitted to the control unit 65. The control unit 65 is connected to the halogen lamp 54 so as to control ON/OFF thereof.

The initialization program P1 executed on the ROM 62 immediately after turning ON the power is described with reference to the flowchart of FIG. 3. When the initialization program P1 is executed, the temperature of the heat roller 52 is detected by the thermistor 55 after various initialization processes, such as a memory check, are performed at the beginning (S101). The detected temperature and a predetermined reference temperature are then compared (S102).

If the detected temperature of the thermistor 55 is lower than or equal to the reference temperature, the halogen lamp 54 is turned ON to raise the temperature of the heat roller 52 (S103). If the detected temperature exceeds the reference temperature, the process of S103 is not performed.

Subsequently, the control program P2 stored in the ROM 62 is copied to the RAM 63 (S104). After the halogen lamp 54 is once turned OFF (S105), the control program P2 read to the RAM 63 in the process of S104 is executed to start the control of the halogen lamp 54 by the control program P2 (S106), and the initialization program P1 is terminated. After the termination of the initialization program P1, the heat roller 52 is controlled to an appropriate temperature by the control program P2.

The control program P2 described above includes a control program of the image forming section 11 in time of printing and a drive control program of various rollers and the like in addition to the program for temperature control of the heat roller 52. Thus, the program size is large and a substantial amount of time is required in the copying process from the ROM 62 to the RAM 63 in S104.

In the present embodiment, however, since the copying process can be performed after the halogen lamp 54 is turned ON and the temperature starts to rise in the initialization program P1 (S103, S104), the heating of the heat roller 52 can be performed in parallel during the copying process that requires time. Therefore, the execution of the control program P2 starts with the temperature of the heat roller 52 raised to a certain extent in advance, and thus the heat roller 52 reaches the target temperature in a short period of time in the control program P2. As a result, a warm-up time immediately after turning ON the power can be reduced, which responds to the needs of the user who hopes to use the device immediately after turning ON the power in an appropriate manner.

In the initialization program P1, the temperature of the heat roller 52 is first examined by the thermistor 55, and the process of turning ON the halogen lamp 54 is performed only if the detected temperature is lower than or equal to the predetermined temperature (reference temperature) (S101 to S103). Therefore, if the temperature of the heat roller 52 is already sufficiently raised and is higher than the reference temperature such as when turning ON the power immediately after turning OFF the power, heating by the halogen lamp 54 is not performed during the copying process of S104, and overheating of the heat roller 52 can be avoided.

Furthermore, a control of once turning OFF the halogen lamp 54 before activating the control program P2 is performed in the initialization program P1 (S105). Thus, the halogen lamp 54 is reliably turned OFF at a start of execution of the control program P2, and thus temperature of the heat roller 52 is prevented from being raised in excess even if the control program P2 goes out of control during the execution.

As described above, the copy-facsimile multifunction peripheral 75 of the present embodiment includes the halogen lamp 54 for fusing the toner on the paper 100. The control unit 65 of the copy-facsimile multifunction peripheral 75 also includes the ROM 62 for storing the initialization program P1 and the control program P2, and the RAM 63 for reading the control program P2. The initialization program P1 stored in the ROM 62 is configured to turn ON the halogen lamp 54 before copying the control program P2 from the ROM 62 to the RAM 63. In other words, the step of turning ON the halogen lamp 54 (S103) is performed before the step (S104) of copying the control program P2 from the ROM to the RAM.

A temperature of the halogen lamp 54 and the heat roller 52 must be raised to a certain extent during the copying process of the control program P2 from the ROM 62 to the RAM 63. Therefore, after the start of execution of the control program P2, the heat roller 52 can rapidly reach a temperature suited for printing, copying and the like, and can rapidly start after turning ON the power.

The copy-facsimile multifunction peripheral 75 of the present embodiment includes the thermistor 55 for detecting the temperature of the heat roller 52. When the initialization program P1 is executed in the copy-facsimile multifunction peripheral 75, the detected temperature of the thermistor 55 is examined before copying the control program P2 from the ROM 62 to the RAM 63, and the halogen lamp 54 is turned ON only if the detected temperature is lower than or equal to the reference temperature. In other words, in the initialization program P1, the temperature of the heat roller 52 is detected, and the step (S103) of turning ON the halogen lamp 54 is performed only if the detected temperature is lower than or equal to the predetermined temperature.

Thus, heating by the halogen lamp 54 is not performed during the copying process of the control program P2 if the temperature of the heat roller 52 is already sufficiently raised and exceeds the reference temperature when the power is turned ON, whereby overheating of the heat roller 52 can be avoided.

When the initialization program P1 is executed in the copy-facsimile multifunction peripheral 75, the halogen lamp 54 is turned OFF in the case where the halogen lamp 54 is turned ON at that time, after the control program P2 is copied from the ROM 62 to the RAM 63. In other words, in the initialization program P1, the step (S105) of turning OFF the halogen lamp 54 is performed after the step (S104) of copying the control program P2 from the ROM 62 to the RAM 63.

Thus, the halogen lamp 54 is reliably turned OFF at the start of execution of the control program P2 even in times of unexpected occurrence such as the control program P2 going out of control during execution, whereby the temperature of the heat roller 52 is reliably prevented from being raised in excess.

In the present embodiment, the ROM (non-volatile memory) 62 is used as a memory for storing the initialization program P1 and the control program P2, and the RAM (volatile memory) is used as a memory to which the control program P2 is copied.

The initialization program P1 and the control program P2 are thus stably stored in the ROM 62 and an inexpensive RAM 63 can be used as a memory for copying destination, thereby reducing the cost.

An embodiment of the present invention has been described above, but such configuration may be modified as below.

In place of the thermistor 55 for detecting the surface temperature of the heat roller 52, an appropriate temperature sensor for detecting the temperature of the halogen lamp 54 itself may be arranged inside the heat roller 52. The ROM 62 may be changed to a non-volatile memory such as EEPROM. Furthermore, the RAM 63 may be changed to a memory capable of holding the storage content when the power is turned OFF for a short period of time or a non-volatile memory in which the content is rewritable.

The heater for heating the heat roller 52 of the fuser device 51 is not limited to the halogen lamp 54, and may be changed to other types of heaters such as xenon flash lamp and induction heating.

The configuration of this embodiment is not limited to a copy-facsimile multifunction peripheral, and may be applied to image forming devices of various electro-photographic methods such as copy, facsimile, and printer.

While the present invention has been described with respect to embodiments thereof, it will be apparent to those skilled in the art that the disclosed invention may be modified in numerous ways and may assume many embodiments other than those specifically set out and described above. Accordingly, the appended claims are intended to cover all modifications that fall within the true spirit and scope of the present invention.

What is claimed is:

1. An image forming device equipped with a heater for fusing toner on a recording medium, the image forming device comprising:

a first memory for storing an initializing program and a control program;

a second memory for reading the control program; and a temperature sensor for detecting a temperature of the heater or a member heated by the heater; wherein the initialization program stored in the first memory is configured to be able to drive the heater before the control program is copied from the first memory to the second memory, the initialization program examines a detected value of the temperature sensor before copying the control program from the first memory to the second memory, copies the control program regardless of the output of the temperature sensor, and drives the heater only if the detected value is lower than or equal to a predetermined temperature, and the initialization program stops the heater if the heater is being driven after copying the control program from the first memory to the second memory.

2. The image forming device according claim 1, wherein the first memory is a non-volatile memory and the second memory is a volatile memory.

3. A method of controlling an image forming device equipped with a heater for fusing toner on a recording medium, the method comprising:

a first step of driving the heater;

a second step of copying a control program stored in the memory to another memory; and a third step of turning the heater off to end temperature control, wherein the first step is performed before the second step, a temperature of the heater or a member heated by the heater is detected, the second step is executed regardless of the detected temperature, and the first step is executed only if the detected temperature is lower than or equal to a predetermined temperature, and the third step is performed after the second step.

4. A non-transitory computer-readable storage medium encoded with an initialization program comprising a set of instructions for executing a method of controlling an image forming device equipped with a heater for fusing toner on a recording medium, the method comprising:

a first step of driving the heater, a second step of copying a control program stored in the memory to another memory; and a third step of stopping the heater, wherein the first step is performed before the second step, a temperature of the heater or a member heated by the heater is detected, the second step is executed regardless of the detected temperature, and the first step is executed only if the detected temperature is lower than or equal to a predetermined temperature, and the third step is performed after the second step.

* * * * *